United States Patent [19]
Cassidy

[11] 4,235,080
[45] Nov. 25, 1980

[54] REFRIGERATION AND SPACE COOLING UNIT

[76] Inventor: James L. Cassidy, 66 Prospect St., Turners Falls, Mass. 01376

[21] Appl. No.: 9,163

[22] Filed: Feb. 5, 1979

[51] Int. Cl.[3] ..... F25B 9/00
[52] U.S. Cl. ..... 62/87; 60/715; 62/116; 62/271; 62/402
[58] Field of Search ..... 62/116, 100, 268, 402, 62/87, 271; 60/715

[56] References Cited

U.S. PATENT DOCUMENTS

| | | | |
|---|---|---|---|
| 1,379,102 | 5/1921 | Jefferies | 62/116 |
| 2,132,212 | 10/1938 | Johansson | 60/715 |
| 4,109,470 | 8/1978 | Cassidy | 60/685 |

FOREIGN PATENT DOCUMENTS

| | | | |
|---|---|---|---|
| 179126 | 11/1906 | Fed. Rep. of Germany | 60/715 |
| 500076 | 12/1927 | Fed. Rep. of Germany | 60/715 |
| 505310 | 5/1939 | United Kingdom | 60/715 |

*Primary Examiner*—Ronald C. Capossela
*Attorney, Agent, or Firm*—Ross, Ross & Flavin

[57] ABSTRACT

This invention embodies improvements in evaporative type refrigeration and space cooling units, both as to energy conservation and efficiency and economy of operation. It utilizes the new abentropic principle as set forth in my U.S. Pat. No. 4,109,470, which demonstrates that the energy of the latent heat of vapor is potential energy and need not be discarded as is done in present practice but can be converted to mechanical energy by taking advantage of the fact that the vapor pressure exuded by boiling hot condensate is the same as that of the vapor itself. The difference between this vapor pressure and that of a hard vacuum is sufficient to drive an engine. The energy necessary for the work done is extracted from the latent heat of the incoming vapor causing some of the vapor to condense at its boiling point proportionately as the work proceeds. Herein, a combination turbine and abentropic engine system is used to extract energy from the pressurized vapor and condense it to the liquid state, while assisting the work of the turbine.

4 Claims, 2 Drawing Figures

REFRIGERATION AND SPACE COOLING UNIT

PRIOR ART

Prior practice cooling and refrigerating systems commonly use the evaporative method wherein the vapor of a liquid having a low boiling point such as ammonia or freon is first compressed, which has the effect of raising its tempertaure. The increased heat is allowed to partially dissipate in a heat-exchanger grill called the condenser after which the still partly condensed vapor passes through a pressure relief valve which allows it to expand and cool further to the extent of producing a wet vapor which enters a second heat-exchanger grill where it evaporates to dryness and absorbs heat from the stream of air or other warmant passing through the grill. From the evaporator the vapor is returned to the compressor for recycling.

THE INVENTION

The invention dispenses with the first heat-exchanger grill of the prior art and also the pressure relief valve. In their places a combination turbine and abentropic engine system is used to extract energy from the pressurized vapor and condense it to the liquid state.

An abentropic engine is a standard engine of modified design which operates at low pressures and temperatures such as those found in exhaust steam from a turbine. Unlike an ordinary engine, however, which runs on a diminishing pressure gradient, the abentropic engine runs at constant pressure and temperature and produces no exhaust vapor, all of the inlet vapor being reduced to liquid condensate. The chief modification, aside from rotor design, consists of installation of a system of drainage ducts properly valved to lead off the condensate and, in a reciprocating type of engine, design changes in cylinder valves and cut-off. In both types of engine sufficient jacketing and insulation to retain constant temperature is required.

In operation, the low pressure of spent turbine steam is opposed against a hard vacuum causing a piston or turbine rotor to move. In doing such work, energy is extracted from the vapor which causes a proportionate amount of it to condense at its boiling point. The key of the matter is that the boiling condensate exhibits the same vapor pressure as the vapor itself thus insuring continuous operation of the engine with the energy required being supplied from the latent heat content of the vapor as it condenses.

The turbine type of engine as shown and described herefollowing can be mounted directly on the main turbine shaft by properly designed rotor blades and conforming shape.

The resultant liquid condensate is led to a second or evaporating heat-exchanger where it absorbs heat from a passing air stream or other warmant. When vaporized, the working fluid is returned to a compressor for recycling. This procedure has the following advantages over prior art units: (a) it wastes no energy to heat the outside; (b) it uses the saved energy to run a fan and other auxiliary equipment; and (c) it requires less electric power for operation.

THE DRAWING

DETAILED DESCRIPTION OF THE DRAWING

Figure 1:
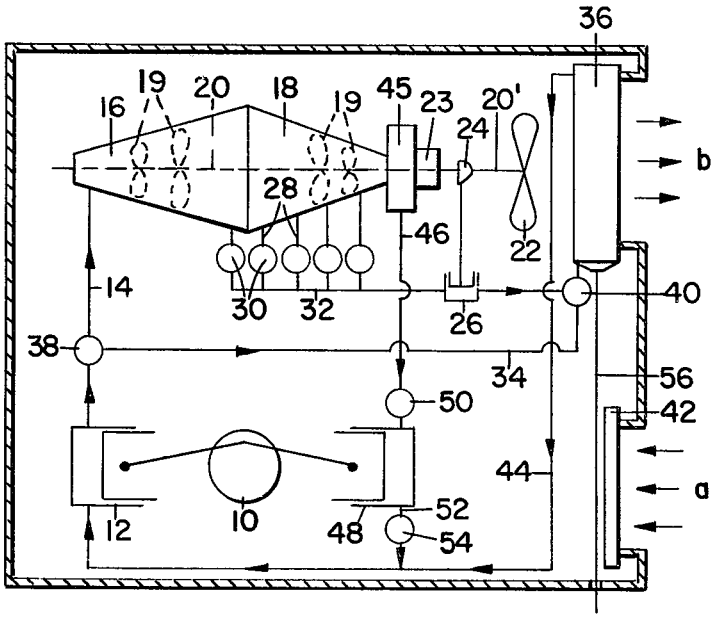
FIG. 1. PRIOR ART
FIG. 1 is a schematic showing of a unit embodying the invention.

FIG. 1 is a schematic showing of a unit embodying the invention suitable for use in a room or space cooler or in a refrigerator. An electric motor 10 of power suitable to its usage is linked to a compressor 12 feeding pressurized and consequently heated vapor through a line 14 to a combination turbine 16 and abentropic engine 18 mounted on a common drive shaft 20 which extends longitudinally therethrough. Engine 18 is provided with sufficient jacketing and insulation, not shown, to retain constant temperature therein.

Abentropic engine 18 is a standard turbine-type engine including rotor blades 19, the engine being of modified design so as to operate at low pressures and temperatures such as those found in exhaust steam from a turbine. Unlike an ordinary engine, however, which runs on a diminishing pressure gradient, abentropic engine 18 runs at constant pressure and temperature and produces no exhaust vapor, all of the inlet vapor being reduced to liquid condensate by means to be described. The modifications consist of installation of a system of drainage ducts, to be described, properly valved to lead off the condensate.

While a turbine-type engine has been described and shown, a reciprocating type engine can be employed, with appropriate design changes in cylinder valves and cut-off.

Turbine 16 feeds its spent vapor into the working side of abentropic engine 18 wherein it condenses at its boiling point yielding its latent energy to assist the turbine in driving a fan 22 carried by an extension 20' of drive shaft 20 and extending outwardly from engine 18 through a reduction gear 23.

Drive shaft extension 20' has a cam 24 fitted thereon for driving a pump 26.

Cold condensate is drawn off from turbine 16 and the non-working side of engine 18 via a plurality of drainage lines or ducts 28 having valves 30 therein to a line 32 which passes through pump 26 and connects with a line 34 leading from the lower end of an evaporator or heat exchanger 36. Line 34 connects at its opposite end with a valve 38 in line 14.

A valve 40 is disposed between pump 26 and evaporator 36 at the point of intersection of lines 32 and 34.

When used as a space cooling unit a stream of warm room air or other warmant enters the unit in the direction of the arrows a through a filter 42 and is forced by the action of the fan 20 through evaporator 36 as cooled air in the direction of the arrows b.

Similarly, when used as a refrigerator unit in such as a supermarket refrigeration system, the heat exchanger acting as evaporator cools the circulating fluid refrigerant.

Vapor from evaporator 36 is returned to compressor 12 for recycling by a return line 44 leading from the upper end of the evaporator.

A vacuum chamber 45 disposed at one end of engine 18 is connected by a line 46 to an evacuator 48 linked to motor 10. Evacuator 48 sets up a hard vacuum in vacuum chamber 45, the hard vacuum opposing the low pressure of spent turbine steam in abentropic engine 18 causing the turbine rotor blades 19 thereof to move.

A valve 50 is disposed in line 46 between vacuum chamber 45 and evacuator 48.

A line 52 leading from evacuator 48 and connecting with return line 44 has a valve 54 disposed therein.

A drainline 56 is provided and leads from the lower end of evaporator 36 outwardly of the unit.

The valves 38, 40, 50 and 54 provide a means of diverting the pressurized and heated vapor output of the compressor to bypass the turbine 16 and abentropic engine 18, with the pressurized and heated vapor entering evaporator 36 via line 34 for the purpose of warming and defrosting the frost clogged grill of the evaporator at necessary intervals as determined by a sensor, not shown. The vapor from the evaporator is returned to the compressor via line 44.

OPERATION

In the operation of the refrigerating unit of the invention, the vapor of a suitable working fluid is first compressed at compressor 12 and fed via line 14 to turbine 16 where its free energy (Helmholtz) is used to drive the turbine which powers circulating fan 22 and the auxiliary equipment including pump 26 and thus lowering its pressure and temperature to the point where the working fluid is near its point of condensation. As turbine exhaust spent vapor it passes into the working side of abentropic engine 18 wherein it condenses at its boiling point yielding its latent energy as additional work assisting the turbine, with the low pressure of the spent turbine steam in the non-working side of engine 18 being opposed against the hard vacuum in vacuum chamber 45 thereby causing the engine rotor blades 19 to move.

In doing such work, energy is extracted from the vapor which causes a proportionate amount of it to condense at its boiling point. The key of the matter is that the boiling condensate exhibits the same vapor pressure as the vapor itself thus insuring the continuous operation of the engine with the energy required being supplied from the latent heat content of the vapor as it condenses.

The resultant cold liquid is pumped by pump 26 into heat-exchanger grill 36 via lines 28 and 32 wherein it is warmed by a suitable warmant, such as a stream of warm room air being forced through the grill by fan 22 and is made to evaporate. The resultant vapor is returned to compressor 12 via line 44 to be recycled, repeating the above sequence.

THE PRIOR ART

Figure 2:
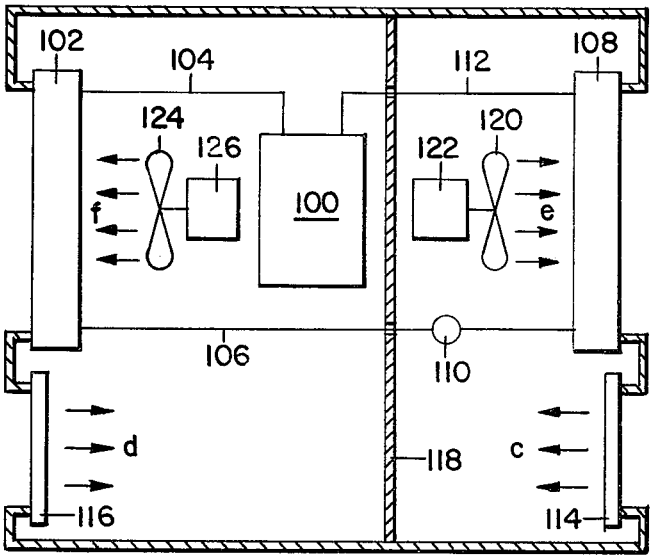
FIG. 2 is a schematic showing of a prior art unit.

FIG. 2 is a schematic representation of a prior art unit.

A compressor 100 is linked to the upper end of a condenser or first heat exchanger 102 at one side of the unit by a line 104.

A line 106 connects between the lower end of condenser 102 and the lower end of an evaporator or second heat exchanger 108 disposed at the opposite side of the unit. A pressure relief valve 110 is provided in line 106.

A return line 112 leads from the upper end of evaporator 108 to compressor 100.

A room air inlet and filter 114 is disposed at one side of the unit below evaporator 108 and permits entry of inside air into the unit in the direction of the arrows c.

An outside air inlet and filter 116 is disposed at the opposite side of the unit below condenser 102 and permits the entry of outside air into the unit in the direction of the arrows d.

A partition 118 separates the unit into two chambers to preclude mixing of inside and outside air.

A room air circulating fan 120 driven by a motor 122 is disposed adjacent evaporator 106 for forcing air therethrough into the room in the direction of the arrows e.

A heat dissipating fan 124 driven by a motor 126 is disposed adjacent condenser 102 for forcing air therethrough to the outside in the direction of the arrows f.

With the unit of the invention, the condenser or first heat exchanger 102, fan 124, motor 126, air inlet and grill 116 and pressure relief valve 110 are all dispensed with and much more economical and reliable combination turbine and abentropic engine system substituted in their place.

I claim:

1. A refrigeration method of the evaporation type comprising the steps:

a. compressing the vapor of a suitable working fluid in a compressor to produce a pressurized and heated vapor;

b. leading the pressurized and heated vapor through an engine of the turbine type where its free energy is used to drive the turbine to power a circulating fan and auxiliary equipment thus lowering its pressure and temperature to the point where it is near its point of condensation;

c. passing the vapor as turbine exhaust spent vapor into an abentropic engine having working and non-working sides wherein it is made to do work by virtue of a pressure imbalance between residual vapor pressure and a hard vacuum on the non-working side, the work extracting energy from the spent vapor causing a proportionate amount of it to condense at its boiling point to produce a cold liquid while yielding its latent energy as additional work assisting the turbine;

d. pumping the resultant cold liquid into a heat-exchanger grill wherein it is warmed by a suitable warmant, such as a stream of warm air being cooled by being forced through the grill which evaporates the contained liquid to produce a vapor;

e. returning the resultant vapor to the compressor to be recycled; and f. repeating the above sequence.

2. A refrigeration method as set forth in claim 1, including diverting the pressurized and heated vapor output of the compressor to bypass the turbine and abentropic engine and enter the heat exchanger grill for the purpose of warming and defrosting a frost clogged grill at necessary intervals as determined by a sensor, the vapor from the heat exchanger grill being returned to the compressor.

3. A refrigeration unit of the evaporation type comprising:

a. a compressor for pressurizing and heating the vapor of a suitable working fluid;

b. an engine of the turbine type operatively connected to the compressor for accepting the vapor wherein its free energy is used to drive the turbine to power a circulating fan and auxiliary equipment thus lowering its pressure and temperature to the point where it is near its point of condensation;

c. an abentropic engine operatively connected to the turbine engine and having a working side for accepting the vapor as turbine exhaust spent vapor and a non-working side;

d. rotor blades in the abentropic engine;

e. means for producing a vacuum on the non-working side of the abentropic engine for establishing an imbalance of pressure for forcing the spent vapor to do work in moving the rotor blades thereby requiring the extraction of energy from the vapor causing some of it to condense at its boiling point to produce a cold liquid thereby transposing the latent heat energy of the spent vapor into mechanical work for assisting the turbine;

f. a heat exchanger grill operatively connected to the compressor and acting as an evaporator; and g. a pump operatively connected to the engine and the heat exchanger grill for pumping the resultant cold liquid into the heat-exchanger grill wherein it is warmed by a suitable warmant, such as a stream of warm air being forced through the grill to evaporate the liquid.

4. A refrigeration unit as set forth in claim 3, including means for diverting the pressurized and heated vapor output of the compressor by bypass the turbine and abentropic engine and enter the heat exchanger grill for warming and defrosting a frost clogged grill at necessary intervals.

* * * * *